United States Patent [19]

Kirpichnikov et al.

[11] 4,037,070

[45] July 19, 1977

[54] TURNTABLE-TYPE MICROWAVE CONTINUOUS OVEN

[76] Inventors: Vladimir Pavlovich Kirpichnikov, Sevastopolsky prospekt, 14, kv. 264, Moscow; Jury Veniaminovich Leibin, ulitsa Raevskogo, 3, kv. 36, Leningrad; Samuil Veniaminovich Nekrutman, Lomonosovsky prospekt, 19, kv. 264, Moscow; Alexandr Nikolaevich Vyshelessky, Petrovsko-Razumovsky proezd, 7, kv. 28, Moscow, all of U.S.S.R.

[21] Appl. No.: 587,885

[22] Filed: June 18, 1975

Related U.S. Application Data

[63] Continuation of Ser. No. 481,844, June 21, 1974, abandoned.

[51] Int. Cl.[2] ..... H05B 9/06

[52] U.S. Cl. ..... 219/10.55 A; 99/443 R; 219/10.55 D; 219/10.69

[58] Field of Search ..... 219/10.55 R, 10.55 D, 219/10.55 A, 10.55 E, 10.55 F, 10.69; 99/443 R, 427, 451; 126/338, 41 A

[56] References Cited

U.S. PATENT DOCUMENTS

| | | | |
|---|---|---|---|
| 2,920,177 | 1/1960 | Brane | 126/41 A |
| 3,151,230 | 9/1964 | Britton | 219/10.55 A |
| 3,404,620 | 10/1968 | Smith | 219/10.55 R |
| 3,531,871 | 10/1970 | Sahara | 219/10.55 R |
| 3,566,066 | 2/1971 | Borthwick | 219/10.55 R |
| 3,614,924 | 10/1971 | Hickey | 99/443 X |
| 3,676,058 | 7/1972 | Gray | 219/10.55 R |

*Primary Examiner*—Arthur T. Grimley

[57] ABSTRACT

The present invention relates to thermal electric equipment, and more particularly to microwave continuous ovens intended primarily for heating and cooking foodstuffs. The microwave oven according to the invention, comprises a microwave electromagnetic oscillator connected to the inner space of a housing accommodating a rotor whose shaft carries two disks which define therebetween a space divided by radial partitions rigidly connected to the disks and the shaft, which all together form sections to accommodate dielectric supports with the product being treated, with said housing being of such cross-sectional shape that in the course of rotor rotation a number of radial partitions are in contact with the inner surface of the housing to form locking compartments, with a loading-unloading opening being arranged in that part of the housing, while the remaining radial partitions are at a distance from the inner surface of the housing, which form together with the latter, a working chamber inside which the product is treated.

2 Claims, 2 Drawing Figures

TURNTABLE-TYPE MICROWAVE CONTINUOUS OVEN

Figure 1:
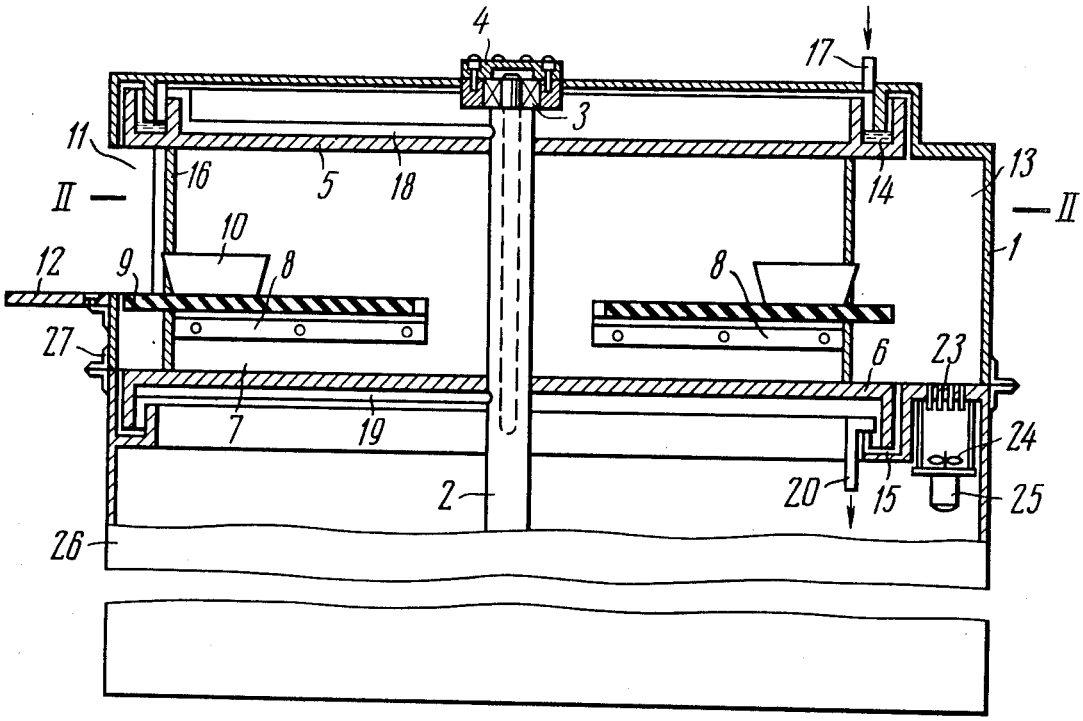

This is a continuation of application Ser. No. 481,844 filed June 21, 1974, now abandoned.

This application discloses subject matter which is related to the disclosures in copending application Ser. No. 601,488, filed Aug. 4, 1975 (which is a continuation of application Ser. No. 481,844, filed June 21, 1974, now abandoned), and application Ser. No. 651,397, filed Jan. 22, 1976 (which is a continuation of application Ser. No. 484,221, filed June 28, 1974, now abandoned).

The present invention relates to thermal electric equipment, and more exactly to microwave continuous-action ovens for heating dielectric materials in microwave electromagnetic fields, and particularly for heating food-stuffs at public catering establishments, and in the food and canning industry.

Microwave ovens similar to the instant type used primarily for thermal treatment of food-stuffs are known in the art.

One prior-art microwave oven comprises a microwave electromagnetic oscillator connected through a slot-type exciter to a working chamber having a loading-unloading opening closed by a door. Installed inside the working chamber for the purpose of uniformly heating the product, is a rotating frame carrying dielectric shelves onto which products for treatment are placed.

A disadvantage of this known microwave cyclicaction oven is its low productivity, because the loading and unloading of the products being treated require that the operation of the microwave oven be discontinued for this purpose; yet without switching off the oven, it is impossible to prevent dissipation of microwave energy from the working chamber.

In addition, due to the short-time duration of the thermal treatment process, and the inconvenient loading and unloading of the product being treated, the oven utilization factor, i.e., the duration of an entire cycle (loading - thermal treatment - unloading) is very low. Because of the cyclic mode of operation of the microwave electromagnetic oscillator the service life of the latter is considerably reduced.

The optimum conditions for the food-stuff thermal treatment process is also made more difficult.

Also known are microwave continuous-action ovens, comprising a conveying device taking the form of a continuous band or chain to carry the products being treated. In order to prevent the dissipation of microwave energy into the environmental space, microwave ovens are provided with cut-off attenuators positioned at the conveying device working zone.

A disadvantage of this known microwave continuous-action oven is associated with its large size, and its use of a relatively large amount of metal in manufacture, as well as its unreliable operation of the cut-off attenuators with the resultant dissipation of microwave energy into environmental space. Besides, in these microwave ovens, sanitation of the conveying device carrying the product in the course of thermal treatment is rather difficult.

The general object of the present invention is to obviate the above disadvantages.

Another object of the present invention is to provide a microwave continuous oven which would feature high productivity, a small size, light weight, and which is able to ensure the required treating conditions, and higher preformance characteristics due to an improved design and layout of the microwave oven.

These objects are achieved by the provision of a microwave continuous oven primarily for heating and cooking food-stuffs, comprising a microwave electromagnetic oscillator connected to the inner space of the housing of the microwave oven to generate electromagnetic oscillation inside said housing, said housing accommodating a rotor with shelves for the food-stuffs, and according to the invention the shaft of the rotor is made from current-conducting material and is adapted to carry two disks installed on the shaft in a plane perpendicular to the plane of rotation thereof; the space between said disks are divided by radial partitions rigidly connected with the disks and the shaft to form together sections accommodating the shelves carrying food-stuff to be placed thereonto; the housing is of such a cross-sectional shape that in the course of rotor rotation a number of the radial partitions forming locking compartments are in contact, through their outer surface, with the inner surface of the housing, while the remaining radial partitions are at a certain distance from the inner surface of the housing so to form, together with said housing, a working chamber with which the microwave electromagnetic oscillator communicates through a waveguide.

In order to prevent dissipation of electromagnetic energy from the working chamber, it is expedient to install circular-shaped quarter-wave chokes over the perimeter of both disks, and to fill them with circulating liquid, such as water, for absorbing electromagnetic energy.

This new structural embodiment of a microwave oven, according to the invention, brings forth a highly productive and compact device of small size, and light in weight.

The microwave oven has a continuous-action device capable of carrying out the food-stuff thermal treatment process under optimum conditions. The microwave oven can be easily built into an automatic production line though when used separately it is attended by only one operator.

The simple design permits convenient sanitation of the working chamber, as well as easy repair and mounting.

Quarter-wave chokes installed between the rotor and the housing, as well as locking compartments prevent dissipation of microwave energy into the environmental space to assure safety operation of the microwave oven.

The microwave oven of the instant invention due to its unique design concept requires 27–30 percent less metal to manufacture and occupies 45–50 percent less floor area to mount as compared with a conveyor-type microwave oven energized by electromagnetic oscillator of an equal power rating.

Figure 2:
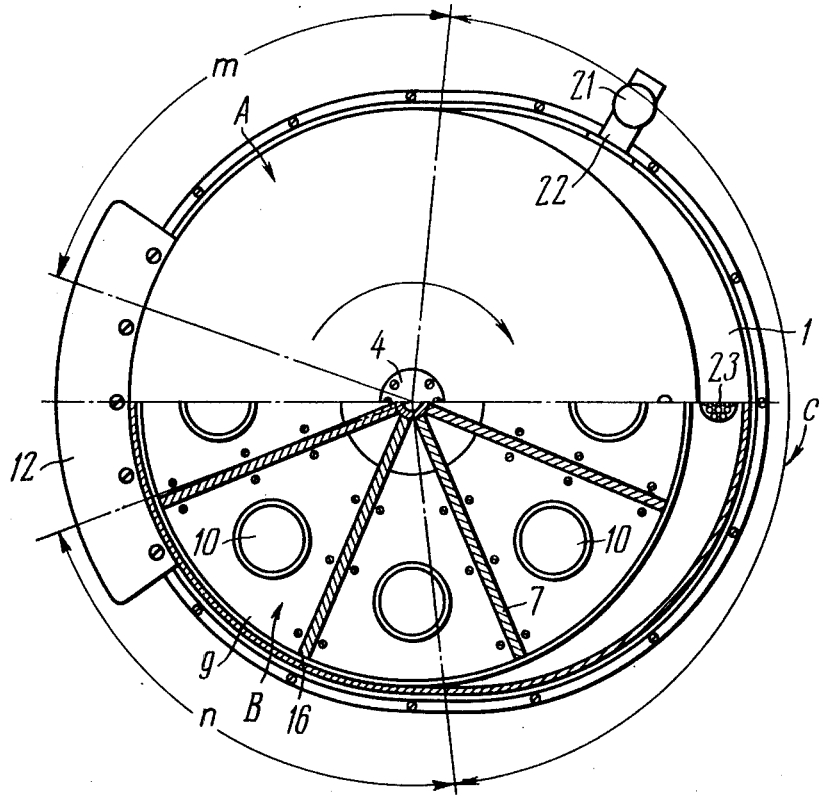

In order to make the present invention more readily understood, a practical embodiment thereof will now be described in more detail with reference to the accompanying drawings, in which:

FIG. 1 is a sectional schematic view of the microwave oven, according to the invention; and FIG. 2 is a sectional view taken along line II-II of FIG. 1.

The microwave oven (FIGS. 1 and 2) comprises a housing 1, accommodating a rotor in coaxial relationship therewith, said rotor taking the shape of a hollow shaft 2 rotating in bearings 3. The upper bearing 3 is closed by a cover 4. Two disks 5 and 6, upper and lower respectively, are rigidly fixed perpendicular to the hollow shaft 2. The space between disks 5 and 6 is divided into equal sections by vertical radial partitions 7 which are rigidly connected to the hollow shaft 2 and the disks 5 and 6.

Dielectric shelves 9, with the product 10 placed thereon for treatment, are installed in each section of the rotor between radial partitions 7 on supports 8.

The portion of the housing 1 to whose side surface the radial partitions 7 are adjacent forms an inlet locking compartment A (its extent being indicated by dashed lines m) and an outlet locking compartment B (its extent being indicated by dashed lines *n*). Arranged between the inlet locking compartment A and the outlet locking compartment B is a loading-unloading opening 11 with a carrier 12. The portion of the housing 1 of the high-frequency oven, which is at a distance from the outer edges of the radial partitions 7, forms together with the rotor a composite working chamber 13.

The dissipation of microwave electromagnetic energy from the working chamber 13 through the loading-unloading opening 11 is prevented by a circular-shaped quarter-wave choke 14 positioned between the upper disk 5 and the housing 1 of the microwave oven, and by a circular-shaped quarter-wave choke 15 positioned between the lower disk 6 and the housing 1. The circular-shaped quarter-wave chokes 14 and 15 are filled with running liquid, such as water, for absorbing electromagnetic energy. The dissipation of microwave electromagnetic energy between the side wall of the housing 1 of the microwave oven and the radial partitions 7 is prevented by flat springs 16 which are in contact with the side surface of the housing 1 in the inlet locking compartment A, and in the outlet locking compartment B.

The liquid, absorbing microwave electromagnetic energy, enters the circular-shaped quarter-wave choke 14 through a pipe connection 17, flows through a pipe 18, further flows through the hollow shaft 2, and a pipe 19, and then enters the circular-shaped quarter-wave choke 15, whereupon it is discharged through a drain pipe connection 20.

The working chamber 13 receives microwave electromagnetic oscillations from an oscillator 21 through a waveguide 22, both installed on the housing 1 above the working chamber 13.

Ventilation of the working chamber 13 is effected throughcut-off attenuators 23 by means of a fan 24 driven by an electric motor 25.

The housing 1 of the microwave oven is mounted on a base 26 and is fixed to the latter by means of a flange joint 27.

The microwave continuous-action oven operates as follows: the product 10 (FIGS. 1 and 2) is loaded from the carrier 12 through the loading-unloading opening 11 onto the dielectric shelf 9 installed on the supports 8 between the radial partitions 7. Each radial partition 7 is rigidly connected to the disks 5 and 6, and the hollow shaft 2.

In the course of rotor clockwise rotation, the product 10 passes through the inlet locking compartment A, and enters the working chamber 13 connected through the waveguide 22 to the microwave electromagnetic oscillator 21. Vapours produced during the thermal treatment of the product are expelled from the working chamber 13 through the cut-off attenuators 23 by means of the fan 24 driven by the electric motor 25.

Upon completion of the thermal treatment, the product 10 reaches the outlet locking compartment B, wherefrom it is discharged through the loading-unloading opening 11 onto the carrier 12.

What we claim is:

1. A turntable type microwave continuous oven with a loading section and a shielded cooking section, comprising: a housing; a microwave electromagnetic oscillator connected to the inner space of said housing for generating electromagnetic oscillation thereinside; a rotor made from current-conducting material positioned inside said housing and in coaxial relationship therewith, the shaft of the rotor carrying two disks installed in a plane perpendicular to that of the shaft rotation; the space confined within said disks being divided by radial partitions rigidly connected to said disks and shaft, which together form sections; dielectric shelves accommodated in said sections for carrying the product being treated about said shaft; said housing being of such cross-sectional shape that in the course of rotation of said rotor a number of said radial partitions which form locking compartments are in contact, through their outer edge, with the inner surface of said housing, while the remaining radial partitions are at a distance from the inner surface of the housing so as to form therewith a working chamber communicating with said microwave electromagnetic oscillator; a loading-unloading opening being arranged between said locking compartments in said housing.

2. The microwave oven as set forth in claim 1, wherein in order to prevent dissipation of microwave electromagnetic energy from said working chamber, circular-shaped quarter-wave chokes are positioned over the perimeter of both said disks, said chokes being filled with running liquid, such as water, to absorb electromagnetic energy.

* * * * *